US008234832B2

(12) United States Patent
Birnbaum et al.

(10) Patent No.: US 8,234,832 B2
(45) Date of Patent: Aug. 7, 2012

(54) CAST-IN CHANNEL

(75) Inventors: Ulrich Birnbaum, Epfenhausen (DE); Juergen Gebhard, Altstaetten (CH); Markus Heudorfer, Buchs (CH); Harald Schachinger, Waidhofen an der Ybbs (AT); Erich Spreizer, Ybbsitz (AT); Denis Novokshanov, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 57 days.

(21) Appl. No.: 12/653,571

(22) Filed: Dec. 16, 2009

(65) Prior Publication Data

US 2010/0170185 A1 Jul. 8, 2010

(30) Foreign Application Priority Data

Dec. 17, 2008 (DE) ..... 10 2008 054 807

(51) Int. Cl.
*E04B 1/38* (2006.01)
*E04C 5/00* (2006.01)

(52) U.S. Cl. ..... 52/710; 52/711; 52/704; 411/85; 411/111; 411/183

(58) Field of Classification Search ..... 52/704, 52/710, 711, 698; 248/317, 916; 411/500, 411/501, 179, 180, 183, 84, 85, 176, 111, 411/375

See application file for complete search history.

(56) References Cited

U.S. PATENT DOCUMENTS

| | | | | | |
|---|---|---|---|---|---|
| 2,144,350 | A * | 1/1939 | Swanstrom | 411/84 |
| 3,493,025 | A * | 2/1970 | La Londe et al. | |
| 4,488,844 | A * | 12/1984 | Baubles | 411/85 |
| 4,571,912 | A * | 2/1986 | Fricker | 52/710 |
| 4,739,601 | A * | 4/1988 | Beine | 52/710 |
| 4,768,907 | A * | 9/1988 | Gauron | 411/85 |
| 4,826,378 | A * | 5/1989 | Pamer et al. | 411/338 |
| 4,948,313 | A * | 8/1990 | Zankovich | 411/85 |
| 5,271,586 | A * | 12/1993 | Schmidt | 248/58 |
| 5,564,873 | A * | 10/1996 | Ladouceur et al. | 411/180 |
| 5,655,865 | A * | 8/1997 | Plank et al. | 411/85 |
| 5,678,377 | A * | 10/1997 | Leopold | 52/656.9 |
| 5,743,062 | A * | 4/1998 | Fricker | 52/704 |
| 5,823,727 | A * | 10/1998 | Lee | 411/85 |
| 5,975,822 | A * | 11/1999 | Ruff | 411/553 |
| 6,637,994 | B2 * | 10/2003 | Leistner | 411/181 |
| 6,824,399 | B2 * | 11/2004 | Smith et al. | 439/82 |
| 6,846,140 | B2 * | 1/2005 | Anderson et al. | 410/104 |
| 6,910,609 | B2 * | 6/2005 | Williams et al. | 224/519 |
| 7,766,295 | B2 * | 8/2010 | Nilsen | 248/317 |

FOREIGN PATENT DOCUMENTS

| | | |
|---|---|---|
| DE | 26 09 815 A1 | 9/1977 |
| DE | 26 19 182 A1 | 11/1977 |

* cited by examiner

*Primary Examiner* — William Gilbert
*Assistant Examiner* — Chi Q Nguyen
(74) *Attorney, Agent, or Firm* — Davidson, Davidson & Kappel, LLC

(57) ABSTRACT

The present invention relates to a cast-in channel having a channel body which forms a receiving space for receiving a connecting element used to fixedly attach a fastening element to the cast-in channel, the channel body further being provided with holes, the holes having connectors provided therein for fixedly attaching anchoring members to the channel body. The connectors are designed as rivets, whose fixing portions, which are inserted through the respective holes, are expanded so as to secure the rivets to the channel body, and which have an attachment for fixedly attaching the anchoring members to the channel body. The present invention also relates to a rivet nut for a cast-in channel.

16 Claims, 3 Drawing Sheets

CAST-IN CHANNEL

This claims the benefit of German Patent Application DE 10 2008 054 807.3, filed on Dec. 17, 2008 and hereby incorporated by reference herein.

The present invention relates to a cast-in channel. The present invention also relates to a rivet nut for such a cast-in channel.

BACKGROUND

Cast-in channels of this type are used to provide flexible fixing points on a cast component, such as one of concrete. To this end, such cast-in channels are placed in the formwork prior to casting the component and incorporated therein during the casting process. Fastening elements can be fixedly attached to the cast-in channels using channel nuts, rear-engagement elements or T-head bolts as connecting elements, which are received in the receiving space within the channel body. The loads are transferred into the cured component via the channel geometry and the anchoring members.

Cast-in channels whose anchoring members are permanently attached to the body of the channel, for example by welding, must be completely manufactured at the factory. Therefore, they take up a large volume during shipping, which results in high shipping costs. In addition, different cast-in channels must be provided for different loads, which requires a considerable logistical effort.

German Patent Application DE 26 19 182 A1 describes a cast-in channel having a channel body which forms a receiving space which is accessible from the outside via a mounting opening and serves to receive a connecting element used to fixedly attach a fastening element to the cast-in channel, the channel body further having a nut welded to its rear wall. The anchoring members each include a shank having a head portion at one end and an external thread at the other end, the external thread being able to be screwed into the internal thread of the welded-on nut so as to fixedly attach the anchoring member to the channel body.

The drawback of the known approach is that the welding process causes a microstructural change in the base material, which has a negative effect on the material properties of the channel body. If a cast-in channel is provided with an anti-corrosion coating to protect it during storage and also against aggressive environments, this anti-corrosion coating is damaged during welding, at least in some regions.

German Patent Application DE 26 09 815 A1 describes a cast-in channel having a channel body which forms a receiving space for receiving a connecting element used to fixedly attach a fastening element to the cast-in channel, the channel body further being provided with holes, the holes having connectors provided therein for fixedly attaching anchoring members to the channel body. The connectors include an engagement portion and a fixing portion which projects from said engagement portion and to which the anchoring members may be fixedly attached, the fixing portion being inserted through the hole in the channel body. The connectors are secured on the channel body to prevent it from being pulled out.

SUMMARY OF THE INVENTION

The drawback of the known approach is the complexity of securing the connectors on the channel body. In the case of a channel body which is provided with an anti-corrosion coating prior to forming the holes in the channel body, this anti-corrosion coating will no longer be present at the free edges of the holes once the holes are made. Even after the connectors are mounted in accordance with DE 26 09 815 A1, the free edges of the holes are no longer adequately protected from corrosion.

It is an object of the present invention to provide a cast-in channel which will overcome the aforementioned disadvantages and which will have adequate corrosion protection, although connectors are provided to fixedly attach the anchoring members to the channel body. Another object of the present invention is to provide a connector for such a cast-in channel.

The present invention provides a cast-in channel having a channel body which forms a receiving space for receiving a connecting element used to fixedly attach a fastening element to the cast-in channel, the channel body further being provided with holes, the holes having connectors provided therein for fixedly attaching anchoring members to the channel body. In accordance with the present invention, the connectors are designed as rivets, whose fixing portions, which are inserted through the respective holes, are expanded, in particular crimped over, so as to secure the rivets to the channel body, and which each have an attachment means for fixedly attaching the anchoring members to the channel body.

When expanding the respective portion of the rivet, this portion of the rivet wraps nearly completely around the edge of the hole, which is no longer corrosion-protected after the holes are formed in the channel body. In this manner, this region of the channel body is adequately protected from corrosion again. Advantageously, the respective portion of the rivet is crimped over, so that this portion of the rivet wraps completely around the edge of the hole that is no longer corrosion-protected. In addition, by being expanded, the connector is reliably secured on the channel body, while requiring little space for the expanded portion, in particular for a crimped over portion. Furthermore, the portion of the channel body in the region of the holes is strengthened. The rivets may be blind or pop rivets, which may have a threaded portion or a bayonet-type connection allowing the anchoring members to be fixedly attached to the channel body in a form-locking manner. The connectors and the channel body may be manufactured from different materials. For example, the channel body may be made from a steel provided with an anti-corrosion coating, while the connectors may be made from an aluminum material, for example. Moreover, rivets having differently configured attachment means may be disposed in holes of the same size. For example, if the rivet has a threaded portion as an attachment means, then a rivet with an M6, M8, M10 or M12 thread can be disposed as a connector in a standard hole having a diameter of 15 mm, for example.

The anchoring members can be attached externally to the body of the channel with respect to the receiving space. This allows the channel body to be provided with an infill, while the anchoring member can still be attached to the channel body. In addition, different types of anchoring members can be attached to the same channel body, which also allows the cast-in channel to be adapted to different load requirements at the construction site, if necessary. Even a previously assembled cast-in channel can be easily adapted to a different type of load, also directly at the construction site, for example. Yet, until the anchoring members are attached to the channel body, the cast-in channel occupies a minimum volume during shipping.

Preferably, the fixing portion of at least one rivet grips around the edge of the hole from the outside relative to the receiving space, so that the fixing portion of the rivet is passed through the receiving space of the channel body and inserted through the hole from the inside, and is then expanded.

Advantageously, the rivet is passed through the externally accessible mounting opening and inserted through the hole. Alternatively, the rivet is passed from one end of the channel body along the length dimension thereof to the respective hole, after which the fixing portion of the rivet is inserted through this hole. This alternative type of installation makes it possible to install rivets having a portion larger than the width dimension of the mounting opening. Since substantially only the expanded portion in the region of the hole projects beyond the outer contour of the channel body, a channel body of this type, in spite of being provided with the connector for fixedly attaching the anchoring members to the channel body, occupies a volume during shipping that is only insignificantly larger than that of one which does not have a connector provided thereon.

In an alternative embodiment, the fixing portion of at least one rivet grips around the edge of the hole from the inside relative to the receiving space, so that the fixing portion of the rivet is inserted through the hole from the outside, and is then expanded on the inside. In spite of the installed connector, the remaining portion of the receiving space is sufficient to allow easy installation of the connecting element, even in small-sized channel bodies. In addition, the rivets can be easily brought to the channel body from the outside.

A channel body may be provided only with rivets that are brought to the intended locations from the inside, or only with rivets that are brought to the intended locations from the outside, but also with rivets that are brought to the intended locations from both the inside and the outside, said rivets being used as connectors for fixedly attaching the anchoring members to the channel body.

Preferably, at least one depression having a bottom portion is provided in the channel body, and at least one of the rivets is located in the bottom portion of the depression. For example, the at least one depression may be provided in the channel body such that it faces outwardly with respect to the receiving space, so that a depression which is cup-shaped, for example, creates additional mounting space for receiving a portion of a rivet, without said rivet portion reducing the mounting space for the connecting element within the receiving space. Advantageously, the rivet located in the bottom portion is oriented with respect thereto so that the attachment means of the rivet projects perpendicularly from the bottom portion. The bottom portion of the at least one depression may be non-concentric in cross section with respect to the rivet located therein. This allows the depression to be adapted according to the loading of the cast-in channel, for example. The bottom portion may be of elliptical or polygonal, such as rectangular configuration. The bottom portion does not have to be minor-symmetrical with respect to the hole located therein. Further, the bottom portion may be circular in cross section, and its center may be offset from the center of the rivet. The bottom portion of the at least one depression is provided with reinforcing indentations, for example, thereby advantageously strengthening this region of the depression and imparting advantageous load-carrying characteristics to the cast-in channel. By providing the depression in the channel body, this portion is work-hardened, so that the material of the channel body has a higher strength in this highly stressed region.

Preferably, the at least one depression points toward the receiving space and forms an indentation which is formed inwardly with respect to the outer surface of the channel body and in which advantageously accommodates the entire expanded fixing portion of the rivet. In this embodiment, even if a rivet is used which grips around the edge of the hole from the outside, no part projects beyond the outer envelope surface of the channel body. Therefore, this channel body occupies little volume during shipping.

Preferably, the rivet is a rivet nut, whose free end, which is inserted through the hole, is expanded so as to secure the rivet nut to the channel body, the rivet nut having an internally threaded portion as an attachment means for fixedly attaching the anchoring members to the channel body. Advantageously, the attachment means is an internally threaded portion provided in a hole which advantageously extends through the entire rivet nut.

A rivet nut according to the present invention for a cast-in channel as mentioned above includes a main body and a collar portion as a fixing portion, said collar portion extending from the main body and being able to be expanded, in particular to be crimped over, the main body having a hole with an internally threaded portion for fixedly attaching the anchoring members, the internally threaded portion extending from the main body into the collar portion. This makes it possible to provide a greater number of thread turns than in a rivet nut that has an internally threaded portion only in the region of the main body. The greater grip length at the rivet nut allows greater loads to be transferred to the base material, whereby the load-carrying capacity of the cast-in channel can be ensured while reducing the amount of material required to manufacture the same. Moreover, because the rivet nut has an internally threaded portion longer than that of conventional rivet nuts, it can be reduced in height and yet have the same load-carrying capacity. This is beneficial especially when the rivet nut is arranged in the receiving space in such a manner that the fixing portion of the rivet grips around the edge of the hole from the outside.

Unlike an insert nut, a rivet nut allows the free edge of a hole made in a corrosion-protected channel body to be protected from corrosion in a reliable and simple manner. In the case of an insert nut, which may also form a connector for fixedly attaching the anchoring members to the channel body, the side of the (mostly hardened) free end bites into the edge of the hole, but does not wrap completely around it, so that the edge is not protected from corrosion in simple way. Thus, an insert nut does not have a fixing portion that could be expanded or, in particular, crimped over.

Preferably, the collar portion has a collar height and the internally threaded portion extends over a maximum of 90% of the collar height. Thus, a sufficient unthreaded portion of the collar portion remains available to be expanded or crimped over. Advantageously, the internally threaded portion extends over 70% to 80% of the collar height.

BRIEF DESCRIPTION OF THE DRAWINGS

The present invention is explained in more detail below with reference to exemplary embodiments. In the drawing.

DETAILED DESCRIPTION

Figure 1:
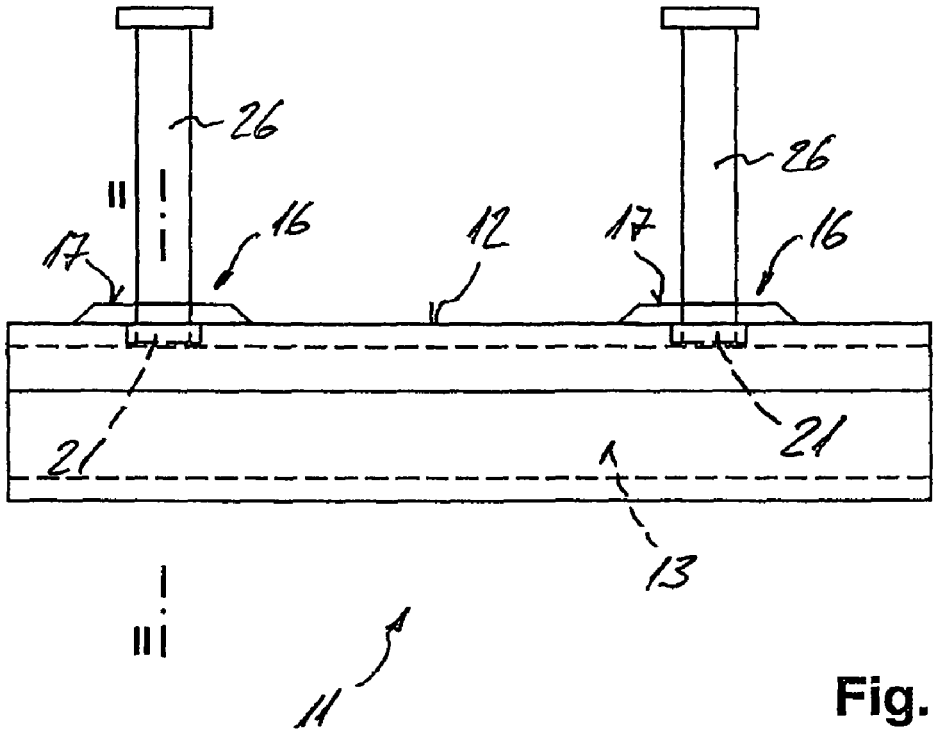
FIG. 1 is a side view of a cast-in channel.

In all of the figures, like parts have been given like reference numerals.

Figure 2:
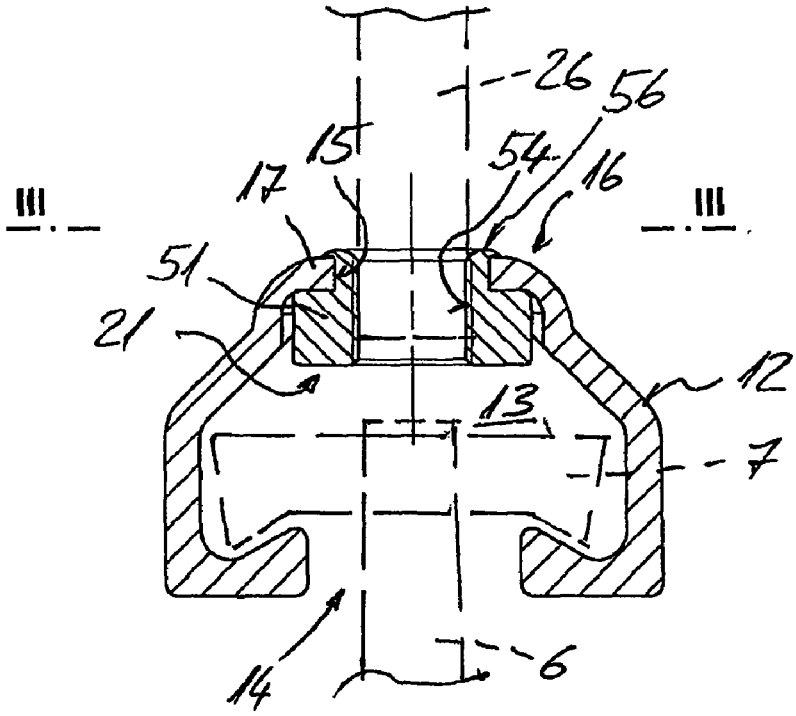
FIG. 2 is a cross-sectional view taken along line 11-11 of FIG. 1.
Figure 3:
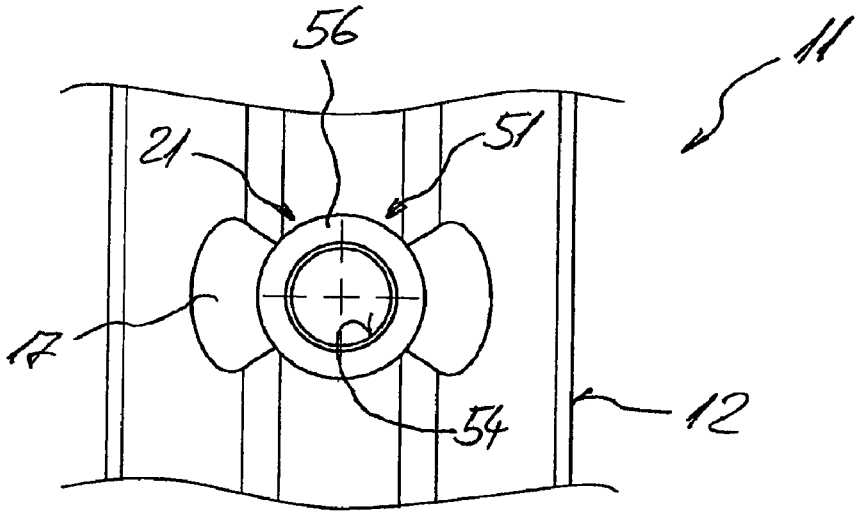
FIG. 3 is a top view of the channel body along the line 111-111 of FIG. 2.

The cast-in channel 11 illustrated in FIGS. 1 through 3 has a channel body 12 and anchoring members 26 fixedly attached thereto. Channel body 12 forms a receiving space 13 for receiving a connecting element 7 used to fixedly attach a fastening element 6 to cast-in channel 11, receiving space 13 being accessible from the outside via a mounting opening 14 extending along the length dimension of channel body 12.

A rear wall of channel body 12 is provided with two depressions 16 which face outwardly with respect to receiving space 13 and which each have a bottom portion 17. Each bottom portion 17 is provided with a hole 15 in which a rivet, here a rivet nut 51, is provided as a connector 21, said connector having an internally threaded portion 54 for fixedly attaching anchoring members 26 to channel body 12. The fixing portion, here collar portion 56, which is inserted through hole 15 and used to secure the rivets to channel body 12, is expanded; in particular crimped over, and grips around the edge of hole 15 at least partly from the outside relative to receiving space 13.

Anchoring members 26 are provided at their free ends with an externally threaded portion, allowing anchoring members 26 to be screwed into internal thread 22 of connector 21 so as to be fixedly attached to channel body 12. Anchoring members 26 are inseparably mounted in connectors 21 by an adhesive, for example, which is provided between the external thread of anchoring member 26 and internally threaded portion 22 of connector 21.

Figure 4:
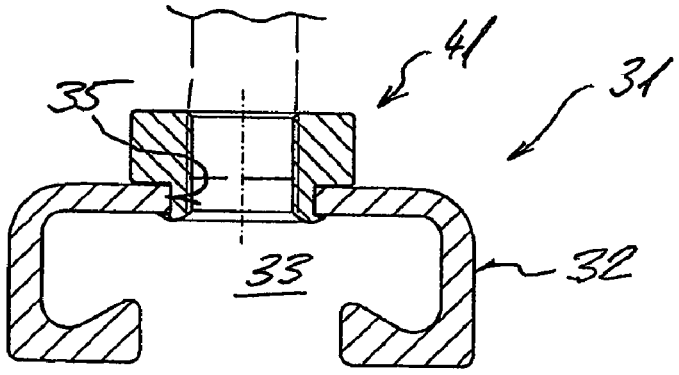
FIG. 4 is a cross-sectional view similar to FIG. 2, showing a second exemplary embodiment of a cast-in channel.

In the case of cast-in channel 31 shown in FIG. 4, connector 41, which is designed as a rivet, is brought to channel body 32 from the outside, so that the fixing portion of the rivet grips around the edge of hole 35 from the inside relative to receiving space 33.

Figure 5:
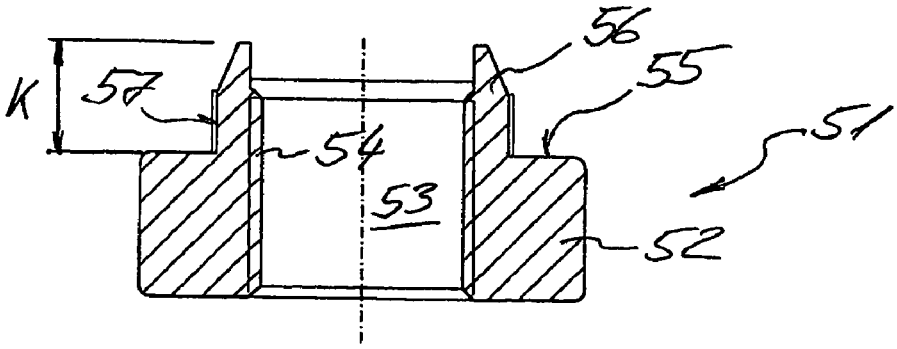
FIG. 5 is a cross-sectional view of a rivet nut for a cast-in channel.

In FIG. 5, a rivet nut 51 for a cast-in channel 11 or 31 is shown in an enlarged view. Rivet nut 51 includes a main body 52 and an extendable collar portion 56 extending from main body 52. Since main body 52 has a larger diameter than collar portion 56, contact surface 55 of main body 52 comes into engagement with the corresponding surface of channel body 15 or 35 as collar portion 56 is inserted through a hole 15 or 35, thereby preventing rivet nut 51 from falling through hole 15 or 35 during mounting thereof. Main body 52 is provided with a through-hole 53 having an internally threaded portion 54 for fixedly attaching anchoring members 26 or 46. Internally threaded portion 54 extends from main body 52 into collar portion 56. Collar portion 56 has a collar height K and internally threaded portion 54 extends over up to 80% of collar height K. Collar portion 56 is provided with a knurled pattern 57 around its outer surface, which comes into contact with the edge of hole 15 or 35. In the assembled condition, knurled pattern 57 penetrates into the edge of hole 15, thereby securing rivet nut 51 from rotation, which allows for easy attachment of the anchoring members.

Figure 6:
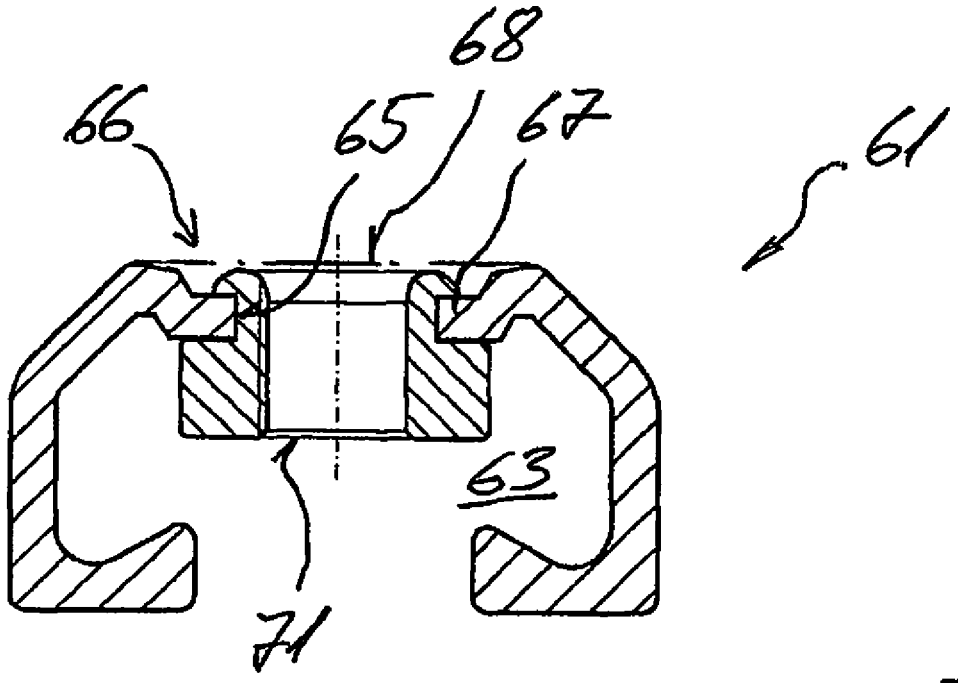
FIG. 6 is a cross-sectional view similar to FIG. 2, showing a third exemplary embodiment of a cast-in channel.

In the case of cast-in channel 61 shown in FIG. 6, a rear wall of channel body 62 is provided with a depression 66 which is directed or faces inwardly with respect to receiving space 63 and which has a bottom portion 67. Bottom portion 67 is provided with a hole 65, in which also a rivet, here a rivet nut, is provided as a connector 71 for fixedly attaching the anchoring members to channel body 62. The fixing portion, which is inserted through hole 65 and used to secure the rivet to channel body 62, is advantageously crimped over and grips around the edge of hole 65 from the outside relative to receiving space 63. The expanded fixing portion of the rivet does not project beyond the outer envelope surface 68 of channel body 62.

What is claimed is:

1. A cast-in channel comprising:

a channel body forming a receiving space for receiving a connecting element used to fixedly attach a fastening element to the cast-in channel, the channel body further being provided with holes, the holes having connectors provided therein for fixedly attaching anchoring members to the channel body, the connectors being rivets, whose fixing portions, which are inserted through the respective holes, are expanded, so as to secure the rivets to the channel body, and which each have an attachment for fixedly attaching the anchoring members to the channel body; and wherein the rivets are crimped over to secure the rivets to the channel body.

2. The cast-in channel as recited in claim 1 wherein the rivets include a first rivet having a first fixing portion and the holes including a first hole, the first fixing portion gripping around an edge of the first hole from an outside relative to the receiving space.

3. The cast-in channel as recited in claim 1 wherein the rivets include a first rivet having a first fixing portion and the holes including a first hole, the first fixing portion gripping around an edge of the first hole from an inside relative to the receiving space.

4. The cast-in channel as recited in claim 3 wherein the at least one depression points toward a receiving space.

5. A rivet nut for a cast-in channel according to claim 4, comprising:

a main body; and a collar portion as the fixing portion, said collar portion extending from the main body and being able to be expanded, the main body having a hole with an internally threaded portion as the attachment for fixedly attaching the anchoring members, wherein the internally threaded portion extends from the main body into the collar portion.

6. The rivet nut as recited in claim 5 wherein the collar portion has a collar height and the internally threaded portion extends over a maximum of 90% of the collar height.

7. The rivet nut as recited in claim 5 wherein the collar portion can be crimped over to be expanded.

8. The cast-in channel as recited in claim 1 wherein the channel body has at least one depression having a bottom portion, and at least one of the rivets is located in a bottom portion of the depression.

9. The cast-in channel as recited in claim 1 wherein the rivet is a rivet nut, whose free end, which is inserted through the hole, is expanded so as to secure the rivet nut to the channel body, the rivet nut having an internally threaded portion as the attachment for fixedly attaching the anchoring members to the channel body.

10. A method for forming the cast in-channel as recited in claim 1, comprising inserting the rivets through the holes and expanding the fixing portions to fix the rivets to secure the rivets to the channel body.

11. A cast-in channel comprising:

a channel body forming a receiving space for receiving a connecting element used to fixedly attach a fastening element to the cast-in channel, the channel body further being provided with holes, the holes having connectors provided therein for fixedly attaching anchoring members to the channel body, the channel body having a wall having an inner surface facing the cast-in channel and an outer surface facing away from the cast-in channel, each hole being located in the wall and having a hole surface extending between the inner surface and the outer surface, the connectors being rivets, each rivet including a main body, a cylindrical portion extending from the main body and having a cylindrical portion diameter less than the main body, and a crimped over portion extending from the cylindrical portion, the cylindrical portion having an outer rivet surface facing the respective hole surface and the main body having a contact surface contacting either the inner surface or the outer surface of the wall, the crimped over portion contacting the other of the inner surface or the outer surface of the wall, and each rivet having an attachment for fixedly attaching the anchoring members to the channel body.

12. The cast-in channel as recited in claim 11 wherein the contact surface contacts the outer surface of the wall and the crimped over portion the inner surface of the wall.

13. The cast-in channel as recited in claim 11 wherein the contact surface contacts the inner surface of the wall and the crimped over portion the outer surface of the wall.

14. The cast-in channel as recited in claim 11 wherein the cylindrical portion has an internal hole, the internal hole being threaded to define the attachment for fixedly attaching the anchoring members to the channel body.

15. The cast-in channel as recited in claim 11 wherein the outer rivet surface includes a knurled pattern.

16. The cast in channel as recited in claim 11 wherein the outer surface of the wall has a depression, the crimped over portion lying in the depression.

* * * * *